US006624130B2

(12) United States Patent
Giblin et al.

(10) Patent No.: US 6,624,130 B2
(45) Date of Patent: Sep. 23, 2003

(54) LAUNDRY PRODUCT

(75) Inventors: Edward John Giblin, Hopatcong, NJ (US); Feng-Lung Gordon Hsu, Tenafly, NJ (US); Janet Mc Donald, Stamford, CT (US); Corinne Saso, Ridgefield Park, NJ (US); Duane Anthony Raible, Park Ridge, NJ (US)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 84 days.

(21) Appl. No.: 09/749,963

(22) Filed: Dec. 28, 2000

(65) Prior Publication Data

US 2002/0086806 A1 Jul. 4, 2002

(51) Int. Cl.[7] ..... C11D 11/00

(52) U.S. Cl. ..... 510/297; 510/296; 229/307; 229/313; 229/316; 383/200; 383/207; 383/208; 383/38

(58) Field of Search ..... 510/296, 297; 229/307, 313, 316; 383/200, 207, 208, 38

(56) References Cited

U.S. PATENT DOCUMENTS

| | | | | |
|---|---|---|---|---|
| 2,760,942 | A | | 8/1956 | Oakley |
| 3,198,740 | A | | 8/1965 | Dunlop, Jr. et al. |
| 3,277,009 | A | | 10/1966 | Freifeld et al. |
| 3,322,674 | A | | 5/1967 | Friedman |
| 3,374,195 | A | | 3/1968 | Bianco et al. |
| 3,413,229 | A | | 11/1968 | Bianco et al. |
| 3,528,921 | A | | 9/1970 | Gray |
| 3,737,027 | A | | 6/1973 | Ball |
| 4,139,475 | A | | 2/1979 | Schwadtke et al. |
| 4,188,304 | A | | 2/1980 | Clarke et al. |
| 4,286,016 | A | | 8/1981 | Dimond et al. |
| 4,348,293 | A | | 9/1982 | Clarke et al. |
| 4,410,441 | A | | 10/1983 | Davies et al. |
| 4,416,791 | A | | 11/1983 | Haq |
| 4,515,703 | A | | 5/1985 | Haq |
| 4,622,161 | A | | 11/1986 | Cornelissens et al. |
| 4,681,228 | A | | 7/1987 | Kerry et al. |
| 4,776,455 | A | * | 10/1988 | Anderson et al. ..... 206/5 |
| 4,844,828 | A | | 7/1989 | Aoki |
| 4,972,017 | A | | 11/1990 | Smith et al. |
| 4,973,416 | A | | 11/1990 | Kennedy |
| 4,974,732 | A | * | 12/1990 | Sullivan et al. ..... 206/610 |
| 5,033,867 | A | * | 7/1991 | Peppiatt ..... 383/29 |
| 5,110,640 | A | | 5/1992 | Mack |
| 5,132,036 | A | | 7/1992 | Falou et al. |
| 5,160,654 | A | | 11/1992 | Falou et al. |
| 5,164,178 | A | | 11/1992 | Muysson |
| 5,234,615 | A | | 8/1993 | Gladfelter et al. |
| 5,316,688 | A | | 5/1994 | Gladfelter et al. |
| 5,384,364 | A | | 1/1995 | Besse et al. |
| 5,429,874 | A | | 7/1995 | VanPutte |
| 5,529,224 | A | * | 6/1996 | Chan et al. ..... 222/212 |
| 5,681,805 | A | | 10/1997 | Scheuing et al. |
| 5,776,877 | A | | 7/1998 | Peterson et al. |
| 5,783,541 | A | | 7/1998 | Tack et al. |
| 6,037,319 | A | | 3/2000 | Dickler et al. |
| 6,040,286 | A | | 3/2000 | Huff |
| 6,124,036 | A | | 9/2000 | Brown et al. |
| 6,133,214 | A | | 10/2000 | Jung et al. |
| 6,136,776 | A | | 10/2000 | Dickler et al. |
| 6,360,942 | B2 | * | 3/2002 | Todjar Hengami ..... 229/129.1 |

FOREIGN PATENT DOCUMENTS

| | | | |
|---|---|---|---|
| EP | 0 011 500 | | 5/1980 |
| EP | 0 040 931 | | 12/1981 |
| EP | 40931 | * | 12/1981 |
| EP | 0 163 417 | | 12/1985 |
| EP | 0 312 277 | | 4/1989 |
| EP | 0 293 139 | | 9/1993 |
| EP | 0 343 069 | | 11/1993 |
| EP | 0 343 070 | | 11/1996 |
| EP | 0 608 910 | | 6/1997 |
| EP | 0 836 108 | | 4/1998 |
| GB | 2 000 177 | | 1/1979 |
| GB | 1 583 082 | | 1/1981 |
| GB | 2 361 686 | | 10/2001 |
| WO | 01/83658 A2 | | 11/2001 |

OTHER PUBLICATIONS

International Search Report on PCT/EP 01/15403 dated Mar. 11, 2002.

Limpopo—1st view–both views show a laundry cleaning gel product sold in Europe in a water–soluble pouch. The base is vacuum formed, filed and then sealed with a "lidding" film, No date.

Limpopo—2nd view–both views show a laundry cleaning gel product sold in Europe in a water–soluble pouch. The base is vacuum formed, filed and then sealed with a "lidding" film, No date.

* cited by examiner

*Primary Examiner*—Charles Boyer
(74) *Attorney, Agent, or Firm*—Kevin J. Stein

(57) ABSTRACT

A new pouch for laundry products and the combination of pouch and laundry product. The pouch includes a tearing notch or a length of weakness, which may comprise a tear tape, permitting manual opening of the pouch prior to tossing the pouch into the washing machine. By tearing open the pouch it is possible to direct liquid or gelled detergent onto clothes for pretreating stains. The remainder of the product, in a second chamber, e.g. liquid, gel or solid, eg, a powder, is retained in the pouch until release during wash. In this respect, it is preferred that at least part of the pouch is a water soluble film to promote release of product during washing in the washing machine and to minimize residue left from the pouch at the conclusion of the wash. The pouch of the invention preferably comprises at least two chambers, one of the chambers being openable by manual tearing along a tearing notch or a line of weakness. In accordance with another embodiment of the invention, a pouch with one or more chambers is provided which narrows to a nozzle for dispensing of product.

9 Claims, 5 Drawing Sheets

LAUNDRY PRODUCT

BACKGROUND OF THE INVENTION

Recently, laundry tablets, a different product form for laundry washing, have been introduced commercially and well received by consumers. This is believed to demonstrate the desirability of unit dose products which can be tossed into the washing machine. The popularity of another form of laundry product, liquid detergents, can be attributed in part to the ability of consumers using such products to pretreat selected areas of clothing which are deemed to require a higher level of cleaning. A disadvantage of laundry tablets is that the option of pretreating selected areas of clothing is not available to consumers in this product form.

Various laundry products in single or dual compartment pouches, or in dual chambered bottles or have been disclosed over the years.

Muysson, U.S. Pat. No. 5,164,178 discloses solid granular deodorant consisting of hydrated calcium sulfate base, essential oils absorbed onto the granular base and micro capsules filled with another portion of essential oils. The granular deodorant is packed in a sealed pouch which has micro holes covered by a removable adhesive tape.

A laundry cleaning gel product is sold in Europe in a water-soluble pouch. The base is vacuum-formed, filled, and then sealed with a "lidding" film.

Peterson et al., U.S. Pat. No. 5,776,877 is directed to a liquid peracid precursor composition for delivering a bleaching and cleaning material in which the composition combines a dispersant medium which includes an emulsifier and a dispersed phase that comprises the peracid precursor. A bottle or container comprised of two chambers may be used.

Scheuing et al., U.S. Pat. No. 5,681,805 discloses a bottle having two chambers for a liquid peracid precursor composition.

Dunlop et al., U.S. Pat. No. 3,198,740 discloses a package of a water-soluble film of polyvinyl alcohol filled with detergent composition. The compositions which are filled in the water-soluble packets are non-liquid, water-soluble synthetic detergents which contain sodium tripolyphosphate and a hydrated salt. Generally such compositions contain one or more anionic synthetic organic detergents. Other ingredients to be filled in the water-soluble packets can be inorganic builders in addition to sodium tripolyphosphate suds builders, alkali metal silicates, bleaching ingredients, and other minor ingredients such as pigments, dyes, perfumes, redeposition inhibitors, optical fluorescers, tarnish inhibitors and other useful additives.

Bianco et al., U.S. Pat. No. 3,374,195 relates to polyvinyl alcohol compositions containing a plasticizer, and to plasticized polyvinyl alcohol films produced therefrom. Use of polyvinyl alcohol films in the manufacture of watersoluble bags or pouches for such materials as detergents, bleaches, insecticides, etc. is mentioned. The package may be dropped in hot or cold water wherein the bags disintegrate and the products are dispensed.

Gray, U.S. Pat. No. 3,528,921 discloses a bleaching packet wherein a dry bleach composition is contained in a packet of water-soluble polyvinyl alcohol film. In use, the entire packet is dropped into a washing machine containing water and clothes to be bleached without any need for pre-measuring by the person doing the washing. The product container, i.e., the polyvinyl alcohol film, is said to contribute considerable soil anti-redeposition properties to the system and thus the packets are said to be especially suited for use in conjunction with soap and detergent products in connection with the washing and bleaching of soiled clothes.

Kerry et al., U.S. Pat. No. 4,681,228 is directed to toxic products situated in a closed inner container consisting of a water-soluble flexible material, the inner container being placed within a closed container consisting of a flexible material which is resistant to water. In order to release the packed substance, the outer container is cut open and the inner container is deposited in water with a film of the inner container and the toxic filling dissolved. Toxic substances are substances, such as agricultural chemicals, which must not come into contact with the human body, both during the filling and packaging and during the transport of the packages and release of the toxic substances from the packages. The water-soluble material is, for example, polyvinyl alcohol and it is filled with a water-soluble toxic powder or granular product. A tear line 7 is included.

Ball, U.S. Pat. No. 3,737,027 is directed to a composite pack for a two component hardening resin comprising two flexible frangible containers, one within the other. The pack is for stabilizing and reinforcing rock formations and for securing elements in bore holes.

Clarke et al., U.S. Pat. No. 4,188,304 discloses a detergent product which comprises a particulate detergent composition contained within a closed waterinsoluble bag which has a water sensible seal. The contents of the bag are discharged on contact of the bag with water. It is said that, if desired, the bag can be formed with more than one separate compartment for different detergent ingredients, or the bags may be formed in a conjoined manner, for instance in a strip to facilitate dosing of different numbers of the bag as appropriate for the wash conditions. It is said that any detergent composition in powder form can be packaged to advantage in the product of the '304 invention.

Davies et al., U.S. Pat. No. 4,410,441 discloses a fabric treatment product which is in the form of a bag having at least two compartments containing particulate fabric treatment compositions. The bag has a first outer wall and an intermediate wall of water insoluble, but water permeable material, and a second outer wall of water impermeable water insoluble plastic sheet. In the washing machine, the wash water first enters the compartment bounded by the first outer wall which is water permeable and dissolves and disperses out its contents. The water subsequently penetrates the intermediate wall to enter the second compartment and dissolve or disperse out its contents. The first compartment may, for instance, contain detergent whereas the second compartment may contain fabric softener.

Cornelissens et al., U.S. Pat. No. 4,622,161 is directed to a dosing unit comprising a detergent and/or bleaching agent contained in a sachet which entirely or partly consists of a sealable substrate and is provided with one or more seams that are sealed with a water sensitive coating composition. It is said that the moment at which the sachet opens up is to a great extent independent of the agitation and heating up behavior of the dishwashing machine. This is obtained by using a coating composition comprising an anionic and/or nonionic water binding polymer and a cationic polymeric adhesive.

Anderson et al., U.S. Pat. No. 4,776,455 is directed to a multi compartment sachet product for the washing machine or dishwasher comprising a first compartment capable of releasing its contents (solid or liquid) within three minutes from the start of the wash process and a second compartment of water permeable material with a pore-occluding coating and/or in the form of a sachet so that the release of its contents (powder), is gradual and is delayed for at least five minutes from the restart of the wash process. The seal of the first compartment may be, for example, sensitive to water temperature or agitation such as the mechanically weak heat seal of EP 11500 or EP 40931.

Oakley, U.S. Pat. No. 2,760,942 discloses a heat sealing coating composition which is water soluble. The compositions contain polyvinyl alcohol and at least one of urea and dextrose. Bond strengths ranging from poor to good, are given for various coating formulations. In one case, a slight seal is obtained. Bond strength in g/in is given for various runs. It is said that packaging films sealed in accordance with the invention can be used to package detergents, food stuffs, etc.

Schwadtke et al, U.S. Pat. No. 4,139,475 is directed to a laundry treatment agent for use in a mechanical laundry dryer comprising a paste of fabric softening substances, textile anti-static, disinfectant and optionally odorants mixed with a liquid, in a package of film material having a pillow-like form with one side impermeable to the substances and the other side having a plurality of slits therein. The slits are of such dimensions that at room temperature and in the absence of pressure on the article, the slits are substantially closed and obstruct the issuance of the paste from the article. Under the influence of the laundry moved in the laundry dryer and the heat prevailing there, the slits open and gradually release the effective substance.

Falou et al., U.S. Pat. No. 5,132,036 discloses a single or multi-compartment sachet containing a particulate bleaching composition which may optionally include detergent ingredients. The sachet system is said to denote for the purposes of the '036 invention any discreet sachet structure. A plurality of single compartments may be joined together in an easily separable manner, for example via a perforated region.

Preferably the '036 sachet system is designed such that the contents will be released at or very shortly after the time of addition to the wash liquor, although it may sometimes be desirable for at least one compartment or sachet thereof to give a delayed or controlled release of treatment agent. The sachet systems may be of a non-opening type where the contents are leached out of the wash liquor through pores in the sachet substrate, or of the opening type where the sachet opens or disintegrates on contact with the wash water. An alternative to a water labile seal is a mechanically weak heat seal which is disrupted by the mechanical action of the washing machine.

GB 2 000 177 is directed to a detergent composition which may be put up in sachet. The sachet may be completely or partly made of a material permeable to or disintegrating in water. The sachet may consist of a material which does not disintegrate in water and which is closed with a strip of material which does disintegrate in water. Alternatively, the sachet may be closed by seams joined with a material that disintegrates in water.

Haq, U.S. Pat. No. 4,515,703 discloses an article suitable for wiping a surface in order to deliver an active material to the surface, or for gradually releasing an active material, such as a bubble bath composition. The article comprises a first substrate layer and a second substrate layer so bonded together as to create a plurality of compartments therebetween, at least some of the compartments containing active material and at least some of the compartments being provided with one or more perforations in one or each of the substrate walls defining the compartments. The active material may be in any suitable form, for example, a solid block, a powder, a gel, a liquid or any combination of these. It is said that the distribution of perforations among the compartments may be either regular or irregular as desired. Different compartments may be provided with different numbers of perforations so that contents of different compartments will be released at different rates.

EP 312 277 is directed to a sealable sachet having a seal which is mechanically strong in the dry state but disintegrates in water at temperatures of 40° C. or below under the influence of mechanical agitation. Preferably the dry bond formed between the wall and the sealant composition should be strong enough that eventual failure of the bond on the application of a pulling force will result in tearing of the non-heat sealable material rather than rupture of the bond. The invention is said to be of special applicability to the home laundry process. Bond strengths are given.

EP 011 500 is directed to particulate detergent compositions contained within a closed bag of sheet material. The bag is constructed so as to open and discharge its contents under mechanical action in a washing machine in use. The seams of the bag may be heat sealed or cold pressured sealed so that at least one seam will burst open in use. The means for opening the bag and discharging its contents under the influence of mechanical action in the washing machine during use may be constituted by closing the bag with at least one weak seal. The mechanism whereby the bag opens depends on the number of factors primarily the strength of the weak seal, in particular its peel strength.

The material used to form the bags should be water insoluble, but preferably water permeable. The preferred bags open by bursting of at least one weak seal which is strong enough to resist opening during transport and manual handling but which will open readily when the bag is agitated in the washing machine. The seals are preferably formed by heat sealing or by cold pressure sealing. Alternatively, at least part of the bag may be made of a material which will disintegrate in use. A still further method of enabling the bag to open and discharge its contents in use is to form the sidewalls of the bag with weakened areas, e.g. in the form of linear slit perforations with a manually removable protective strip positions thereover. Opening of the bag then occurs by bursting at the weakened areas.

It is said that any detergent composition in particulate form can be packaged to advantage in the products of the '500 invention. As an alternative to fully formulated detergent compositions, the bags may contain any one or more of the following treatment materials: bleaches, bleach precursors, fabric softeners, starch, perfumes, antibacterial agents, anti-static agents, whitening or bluing agents, stain removing agents and the like. Perfumes, bleaches, bleach precursors and cationic fabric softening agents are mentioned. The products of the invention are said advantageously to be used for detergent powders containing insoluble ingredients. Dry mixing of the detergent composition is mentioned. If desired, the bags can be formed with more than one separate compartment containing different detergent ingredients at least one of which compartments is adapted to opening in the wash.

EP 040 931 is directed to a fabric treatment product for use in a washing machine comprising a bag formed of water insoluble, water impermeable synthetic plastics sheet material containing a fabric treatment composition comprising a liquid, the bag having a weak seal that will be opened by the mechanical action of a washing machine. The opening seal can comprise a mechanically weak heat seal. The bags may consist of a single compartment or include at least one further external wall defining one or more further compartments. The further wall may be formed of a similar material to the main walls of the bags, in which case it will also need an opening seal. Alternatively, the further wall may be formed of a water soluble film material such as polyvinylacetate/polyvinyalcohol or a water permeable water insoluble material, for example, a fibrous sheet material. Particulate treatment compositions may be present. If desired, the sheet material used to form the bag can be marked or tagged so that it can be easily recognized among the washed fabrics, for example, the material may be printed with a simulated fabric pattern such as a check or gingham.

Bianco et al., U.S. Pat. No. 3,413,229 is directed to polyvinyl alcohol compositions containing a plasticizer useful for laundry packets containing detergents and/or bleaches.

Falou et al., U.S. Pat. No. 5,160,654 discloses a product for treating fabrics in a washing machine in the form of a sachet having at least two compartments. Preferably the sachet is composed of water insoluble, preferably water permeable, sheet or film material and is closed by one or more sheets sensitive to water and/or mechanical agitation. In a second preferred embodiment the sachet is comprised of a water soluble film material. The detergent composition is divided into two or more powder components which are packed separately in the appropriate compartments of the sachet. Half dose units may be joined together in an easily separable manner, for example, via a perforated region.

EP 293 139 is directed to a particulate laundry composition releasably contained within a closed, single or multi compartment sachet having a frangible seal, the sachet being formed of a water insoluble, calender bonded or calender finished, non woven bonded substrate material, which is a thermo-bonded fibrous or filamentous substrate wherein the fibers of filaments are bi-components fibers having a polyester core and a polyethylene sheet. The flangible seal or seals are most conveniently formed using heat bondable, water soluble or water dispersible adhesives.

EP 163 417 is directed to bleach products for use in the washing machine and disposed in a closed bag containing a particulate bleach composition. The bag is formed of sheet material having pores large enough to render it water permeable, but small enough to confine the bleach composition within the bag.

EP 836 108 is directed to bleaching washing agents.

U.S. Pat. No. 6,037,319 discloses water soluble packets with liquid cleaning concentrates.

SUMMARY OF THE INVENTION

The present invention is directed to a new pouch for laundry products and to the combination of pouch and laundry product. The pouch includes a tearing notch or a length of weakness, which may comprise a tear tape, permitting manual opening of the pouch prior to tossing the pouch into the washing machine. By tearing open the pouch it is possible to direct liquid or gelled detergent onto clothes for pretreating stains. The remainder of the product, in a second chamber, e.g. liquid, gel or solid, e.g. a powder, is retained in the pouch until release during wash. In this respect, it is preferred that at least part of the pouch is a water soluble film to promote release of product during washing in the washing machine and to minimize residue left from the pouch at the conclusion of the wash.

The pouch of the invention comprises at least two chambers, one of the chambers being openable by manual tearing along a tearing notch or a line of weakness. That chamber preferably includes a liquid detergent or less preferably a gel detergent. Thus by tearing open the first chamber, it is possible to pour out the liquid detergent (squeeze out in the case of a gel) and pretreat the clothes. The product contained within the second and optionally further chambers is preferably dispensed in the washing machine during washing. Again, a water soluble pouch material would promote dispensing during washing.

In accordance with another embodiment of the invention, a pouch with one or more chambers is provided which narrows to a nozzle for dispensing of product. Preferably the nozzle includes a notch or slits or a length of weakness such as a line of weakness to permit manual tearing open of the nozzle and dispensing of product. Preferably the interior of the chamber which is in communication with the nozzle contains a liquid product which can be readily dispensed through the open nozzle to pretreat desired areas of the clothing. Alternatively, the portion of product in the chamber which is in communication with the nozzle may be a gel which can be dispensed by exerting pressure on the chamber once the nozzle has been opened. Preferably, any chambers in the pouch which are not openable by manual tearing should at least permit dispensing of product at some point while the pouch is in the washing machine. Options include making the pouch of water soluble material, making the pouch of water permeable material, making the seals of a water soluble material, and/or making seals openable by mechanical agitation and/or heat during washing.

The nozzle of the pouch of the invention may be disposed in the center of one side of the pouch, in a corner of a pouch, or otherwise. The nozzle may be funnel-shaped or it might be S-shaped or it may assume a further shape. The pouches of the invention will generally be rectangular, but other forms such as triangular pouches may be used as well.

The pouches of the invention may be prepared from a continuous tube of polyvinyl alcohol film, or other suitable material, which is filled, then sealed, then filled, then sealed.

The invention is also directed to the processes of making the pouches and also to the process of using the pouch whereby the pouch is manually torn open prior to tossing into the washing machine and clothing is pretreated with product from at least one of the chambers.

For a more complete understanding of the above and other features and advantages of the invention, reference should be made to the following Detailed Description of the Preferred Embodiments and to the accompanying drawings.

DETAILED DESCRIPTION OF THE INVENTION

Figure 1:
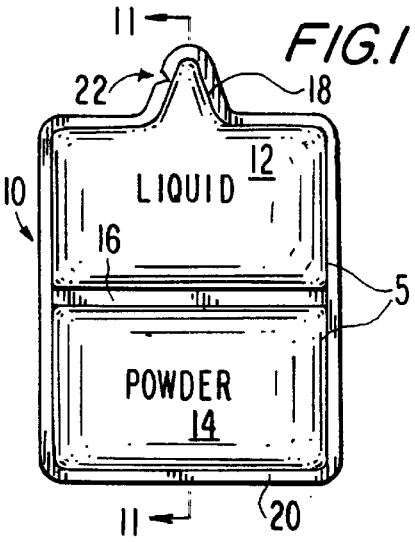
FIG. 1 is a top plan view of a pouch according to the invention.

Referring particularly to FIG. 1, pouch 10 includes two compartments 12 and 14 separated by heat seal 16. First chamber or compartment 12 narrows to nozzle-forming conical aspect 18 at one end of the chamber.

Pouch 10 is heat sealed along its periphery 20, having been formed from a cylindrical sheet of polyvinyl alcohol. A tearing notch 22 in the form of a v-notch or slit is disposed in the heat seal of pouch 10 adjacent nozzle 18. Contained within chamber 12, which is in communication with nozzle 18, is a liquid detergent formulation. Contained within chamber 14 is a powdered detergent formulation.

A length of weakness, such as a (straight) line of weakness which promotes tearing along a controlled path, may be used in place of, or in conjunction with the tearing notch.

In operation, the consumer tears open chamber 12 at notch 22 prior to tossing pouch 10 into the washing machine. This permits the consumer to direct liquid detergent onto particularly soiled aspects of the clothing, as desired. The remaining portion of the pouch is then tossed into the washing machine. The water soluble aspects of chamber 14 permit dispensing of the powder into the wash while the washing machine is in operation.

The product of chamber 12 may also be a gel. The product of chamber 14 may be in any physical state.

Preferably, at least 40% of the surface area of chamber 14 is made from water soluble film, such as polyvinyl alcohol. Alternatively, the seal along the periphery of chamber 14 and/or the separating seal 16 between chambers 14 and 12 may be fabricated from a mechanically weakened seal and/or a water soluble seal. Also, chamber 14 may be formed from a water permeable substance such that the powdered detergent will be leached from the chamber once the pouch has been placed into the wash. Preferably, the entire pouch is made of a water soluble material such that little or none of the pouch and its contents, preferably none of the pouch and its contents, remains after washing has been completed.

Figure 2:
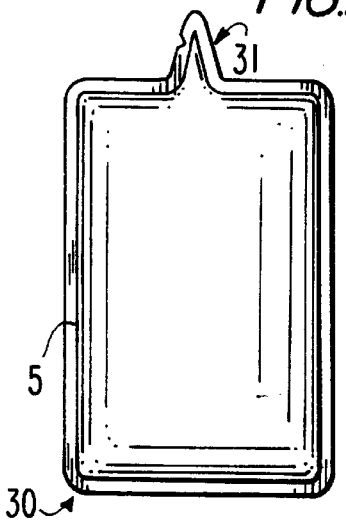
FIG. 2 is a top plan view of an alternate pouch according to the invention.

FIG. 2 represents an alternate embodiment wherein the product is in a single chambered pouch 30 having a nozzle 31. The laundry product can be a liquid, powder or gel.

Figure 3:
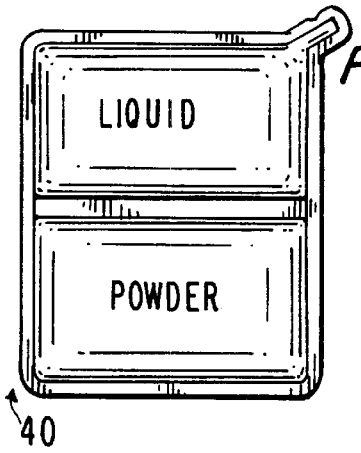
FIG. 3 is a top plan view of a still additional embodiment according to the invention.

The pouch of FIG. 3 is similar to that of FIG. 1, except that the nozzle is disposed in a corner of the (rectangular) pouch.

Figure 4:
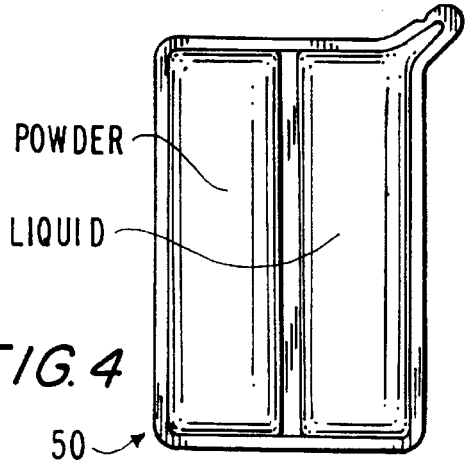
FIG. 4 is a top plan view of another embodiment according to the invention.

The pouch of FIG. 4 is similar to that of FIG. 3, except that the seal dividing the chambers is disposed perpendicularly to that of FIG. 3.

Figure 5:
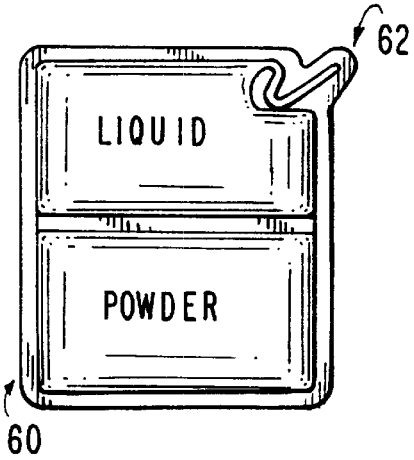
FIG. 5 is a top plan view of a further embodiment according to the invention.

The pouch 60 of FIG. 5 is similar to pouch 40 of FIG. 3 except that an S-shaped nozzle 62 is used for better control of flow.

Figure 6:
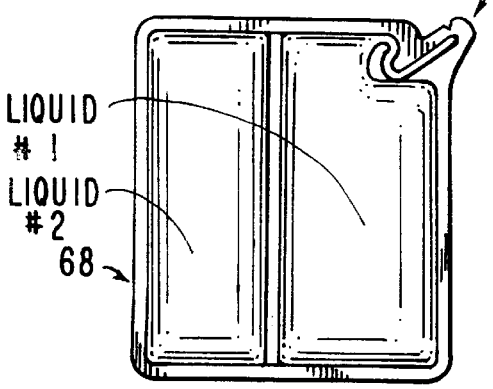
FIG. 6 is a top plan view of a still further embodiment according to the invention.

In the embodiment of FIG. 6, an S-shaped nozzle 66 is used in pouch 68. Each chamber includes a liquid detergent or other laundry treating composition. In this embodiment, use of two chambers permits dosing of a pretreatment amount and a second washing amount.

Figure 7:
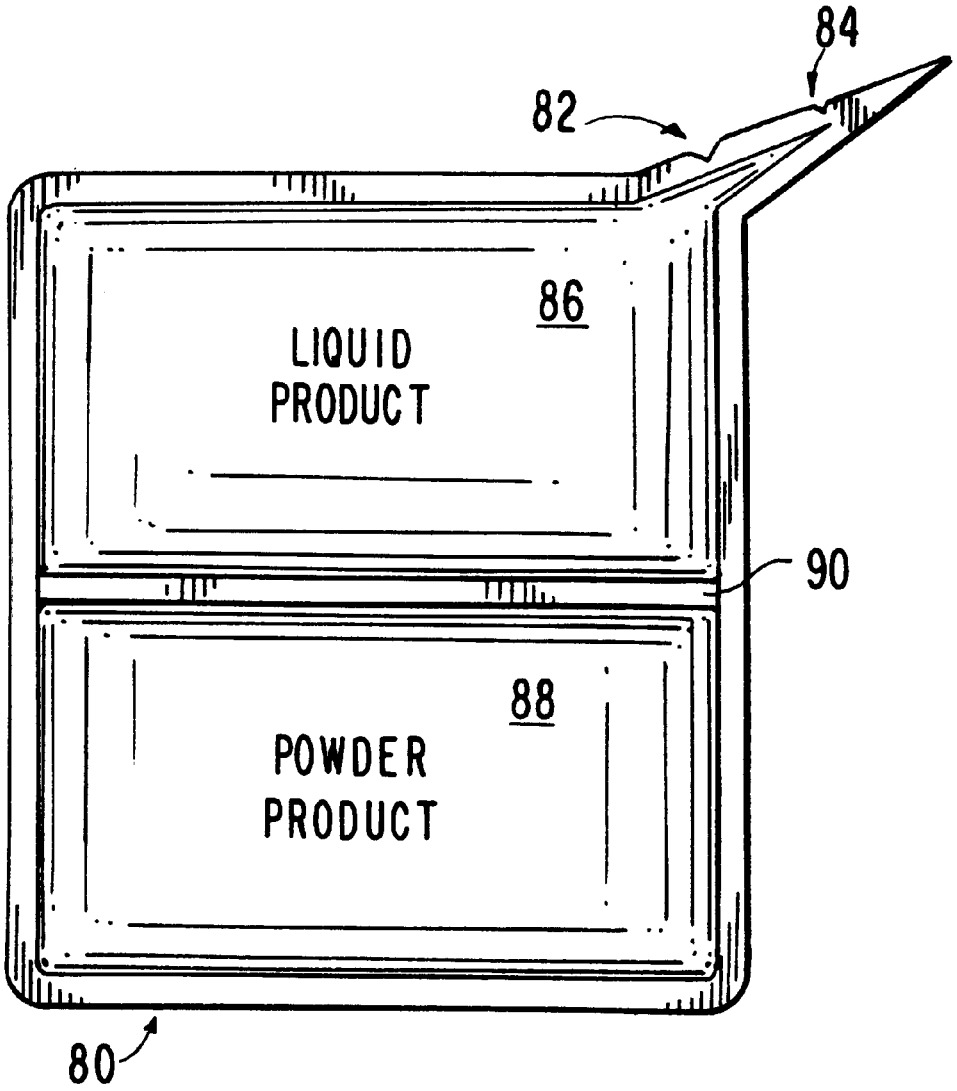
FIG. 7 is a top plan view of another pouch according to the invention.

In the embodiment of FIG. 7, pouch 80 includes two notches, large notch 82 and smaller notch 84 to assist in opening the first chamber 86. Second chamber 88 is separated from first chamber 86 by heat seal 90. Chambers 86 and 88 are made of a water soluble, polyvinyl alcohol film.

Figure 8:
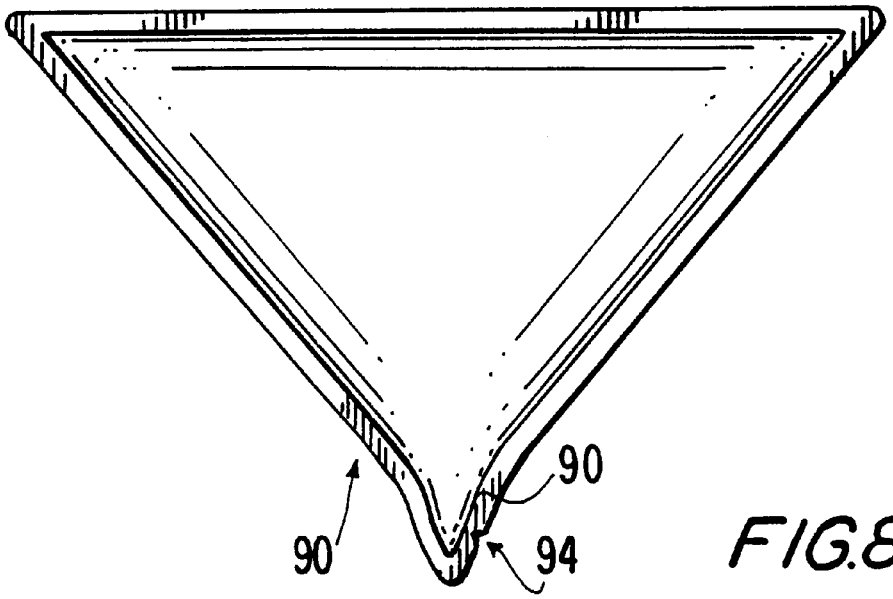
FIG. 8 is a top plan view of another pouch according to the invention.

In FIG. 8, pouch 90 has a triangular body which narrows into wedge- or funnel-shaped nozzle 92 which is adjacent line of weakness notch 94.

Figure 9:
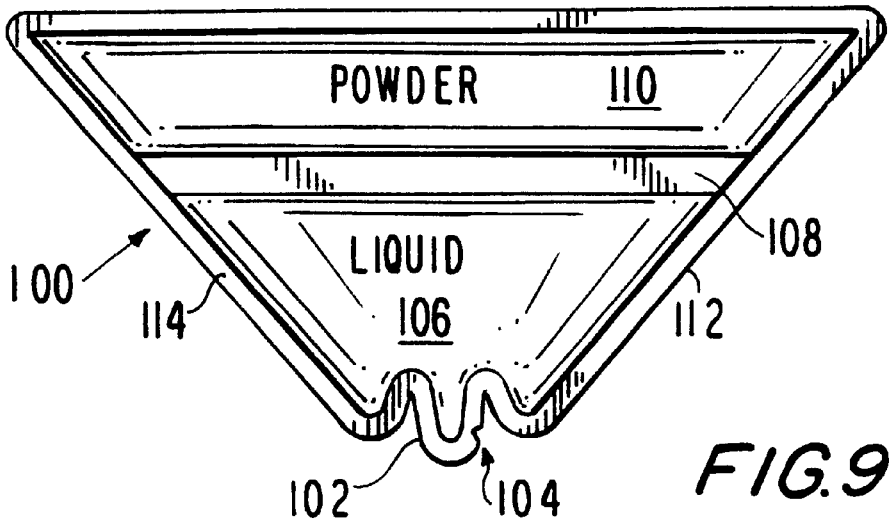
FIG. 9 is a top plan view of a further embodiment according to the invention.
Figure 11:
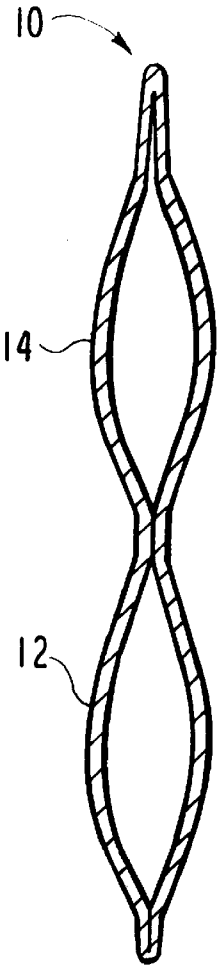
FIG. 11 is a cross section of FIG. 1 according to lines 11—11.

Pouch 100 of FIG. 9 is also triangular and features recessed nozzle 102 having notch 104 which opens from chamber 106 to dispense liquid product. Heat seal 108 separates the polyvinyl alcohol chamber 110 from polyvinyl alcohol chamber 106. The body of pouch 100 is triangular and the nozzle is recessed inwardly from the corner which would otherwise be formed by the sides 112 and 114 of the pouch.

Figure 10:
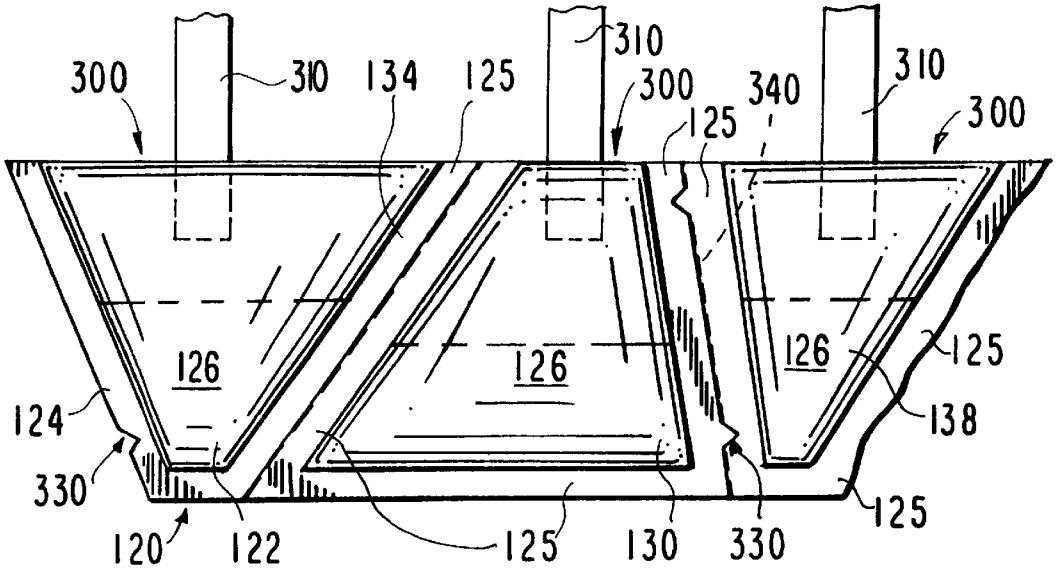
FIG. 10 is an elevational view of pouches being filled.
Figure 10A:
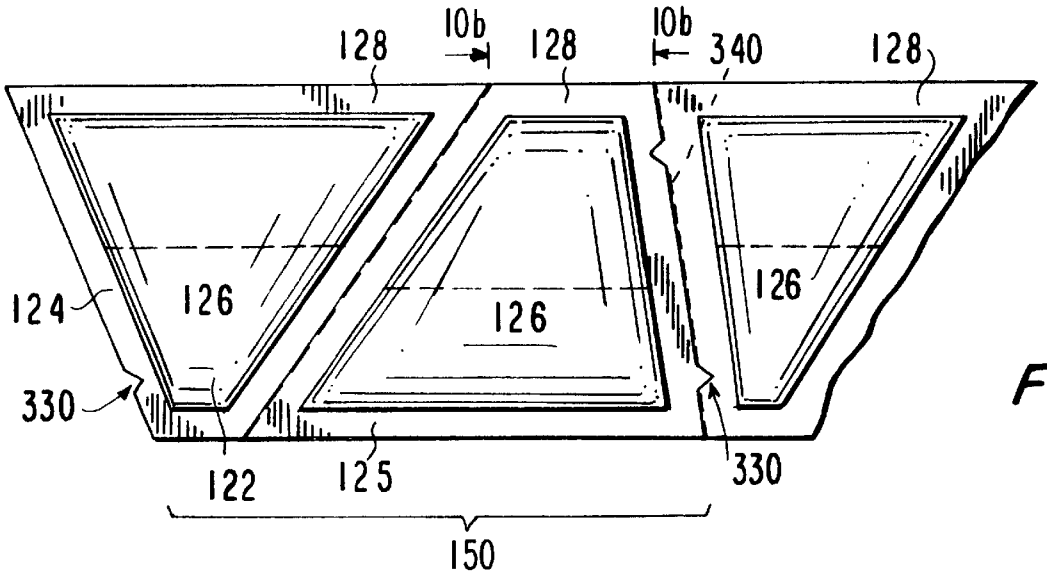
FIG. 10*a* is a top plan view of a polyvinyl alcohol film which has been formed into pouches suitable for use in the present invention.
Figure 10B:
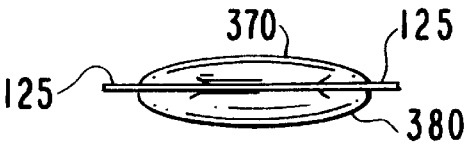
FIG. 10*b* is a section along the lines 10*b*—10*b* of FIG. 10*a*.
Figure 10C:
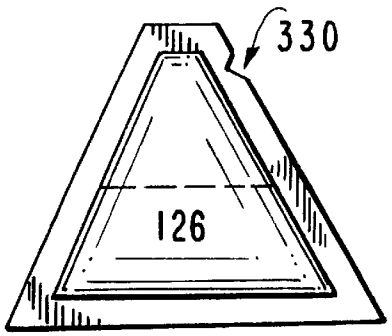
FIG. 10*c* is a top plan view of an individual heat sealed chamber containing a gelled detergent.

The pouch may be formed from a continuous tube of polyvinyl alcohol film or, as seen in FIG. 10, especially 10*b* may be formed from two films 370, 380. One end of chamber 122 is formed by sealing at 124. As illustrated in FIG. 10, other heat seals 125 are also present prior to filling. Openings 300 are provided to accommodate multiple filler nozzles 310. Notches 330 are provided to facilitate opening of one or more of the chambers. Lines of weakness, such as perforated lines 340 are provided to facilitate separations of the chambers. After chambers 122, 130, 138, etc. are filled with liquid product 126, the nozzles 310 are withdrawn and a third side of each of the chambers, is then heat sealed at 128 as seen in FIG. 10*a*.

Referring to FIG. 10, at some point, it may be desirable to separate chamber 130 from chamber 138 adjacent seal line 134 to form pouch 150. Alternatively, the pouch may include only one, or more than two, chambers. For instance, a first chamber may include liquid detergent product for pretreating when the notch is opened. The second chamber may comprise the same or different detergent product contained in a water soluble pouch which dissolves upon placement in the washing machine. Preferably the first chamber is also made of a water soluble film which dissolves in the washer. A third chamber may be provided with fabric softening liquid or solid, and release of product may be deferred to a later time in the washing cycle by use of a water permeable rather than water soluble, film or by use of a seal which is weakened mechanically or chemically so as to release at an appropriate time in the wash cycle.

The pouch shape including nozzle feature would be formed with a shaped heat-sealing form, and the nozzle and notch would be die-cut. This is a form/fill/seal and die-cut operation.

Various combinations of product within multiple chambers are possible, e.g., liquid/liquid, powder/powder, gel/gel, gel/liquid, gel/powder, etc.

The pouch of the invention may be used to contain various laundry products, including but not limited to, laundry detergents, fabric softeners, bleaches, bleach precursors, perfumes, antibacterial agents, anti-static agents, whitening or bluing agents, etc. The laundry products may or may not include enzymes and builders. Laundry detergents generally comprise surfactants such as anionic and/or nonionic surfactants. Fabric softeners often include cationic surfactants. Laundry products which may be considered for use in the present invention include those described in U.S. Pat. Nos. 5,132,036 and 4,420,441, the disclosures which are hereby incorporated by reference.

The pouch may take many shapes as viewed in a plan view, such as rectangular, square, round, triangular, FIG. 8, etc. A notch, slit or perforated line could range in size from 1/16" to 1/2".

The pouch is preferably made of a clear, heat sealable, cold water soluble film such as polyvinyl alcohol. Thickness could range from 1.5 to 3 mils, preferably 2 mils. Other materials from which the pouch can be made include methyl hydroxy propyl cellulose.

It should be understood of course that the specific forms of the invention herein illustrated and described are intended to be representative only, as certain changes may be made therein without departing from the clear teaching of the disclosure. Accordingly, reference should be made to the appended claims in determining the full scope.

What is claimed is:

1. A laundry-treatment article comprising:

(a) a pouch comprised of a water soluble film and having a tearing notch or a length of weakness for manually tearing open said pouch, (b) said pouch containing discrete laundry products:

(i) in separate compartments wherein at least one of said compartments includes the tearing notch or the length of weakness for manually tearing open said compartment and wherein two of said discrete laundry products include a product which is a liquid at 25° C. and a powder.

2. The article according to claim 1 further comprising tearing indicia at said notch or said length of weakness.

3. The article according to claim 1 comprises a tearing notch.

4. The article according to claim 1 wherein said notch or length of weakness is positioned to open said compartment which contains the liquid at 25° C. laundry product.

5. The article according to claim 1 wherein said pouch comprises at least two separate compartments one of which includes said notch or length of weakness and the other of which has an external surface area at least 40% of which is made of a water-soluble film.

6. The laundry treatment article according to claim 1 wherein said film is cold water soluble.

7. The laundry treatment article according to claim 6 wherein said film is clear.

8. The laundry treatment article according to claim 1 wherein said length is curved.

9. The laundry treatment article according to claim 1 wherein said length is straight.

* * * * *